US005927899A

United States Patent [19]

Claesson

[11] Patent Number: 5,927,899

[45] Date of Patent: Jul. 27, 1999

[54] DEVICE IN CONNECTION WITH A FLOATING BODY

[76] Inventor: Hans Claesson, P.O. Box 335, CH-6340 Baar, Switzerland

[21] Appl. No.: 08/817,456

[22] PCT Filed: Sep. 21, 1995

[86] PCT No.: PCT/SE95/01072

§ 371 Date: Mar. 21, 1997

§ 102(e) Date: Mar. 21, 1997

[87] PCT Pub. No.: WO96/09441

PCT Pub. Date: Mar. 28, 1996

[30] Foreign Application Priority Data

Sep. 21, 1994 [SE] Sweden ..... 9403159

[51] Int. Cl.[6] ..... E02B 15/10

[52] U.S. Cl. ..... 405/63; 210/242.1; 210/242.3; 405/70; 405/72

[58] Field of Search ..... 405/60, 63, 68, 405/70, 72; 441/65, 66; 210/241, 242.1, 242.3

[56] References Cited

U.S. PATENT DOCUMENTS

| | | | |
|---|---|---|---|
| Re. 30,438 | 11/1980 | Preus | 405/68 |
| 4,269,538 | 5/1981 | Hauan | 405/63 |
| 5,252,001 | 10/1993 | Quinn | 405/68 |
| 5,372,455 | 12/1994 | Tarca | 405/68 |
| 5,478,168 | 12/1995 | Carr et al. | 405/68 |

*Primary Examiner*—Tamara L. Graysay
*Assistant Examiner*—Tara L. Mayo
*Attorney, Agent, or Firm*—Dvorak & Orum

[57] ABSTRACT

The present invention relates to an arrangement for a floating body consisting of containers made from a flexible material positioned laterally in relation to one another and capable of being filled with air or other gas. Containers thereby communicate with one another via a duct extending outside the aforementioned containers and along the floating body, which duct is situated at a level below the surface of the water in which the floating body is adapted to float in its inflated state.

12 Claims, 9 Drawing Sheets

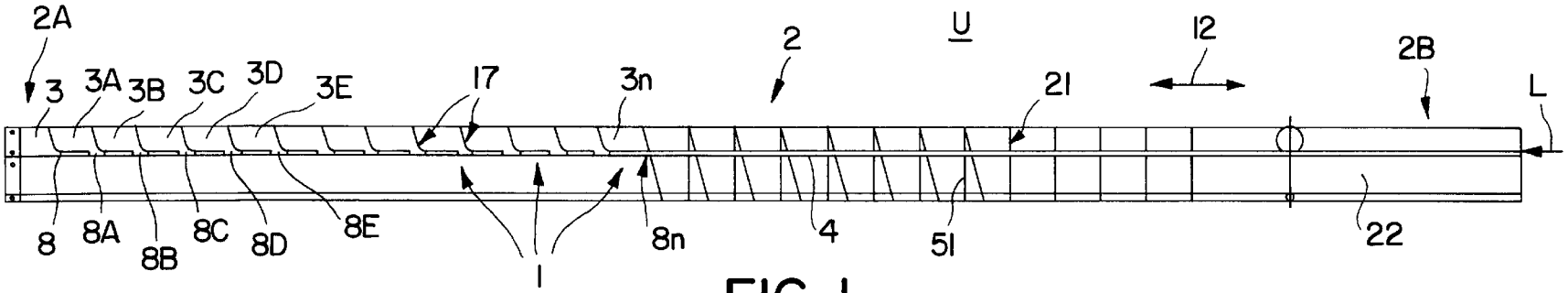
FIG. I
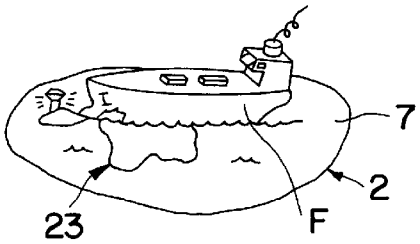
FIG. IA

DEVICE IN CONNECTION WITH A FLOATING BODY

BACKGROUND OF THE INVENTION

The present invention relates to an arrangement for a floating body consisting of containers made from a flexible material positioned laterally in relation to one another and capable of being filled with air or other gas.

DESCRIPTION OF THE PRIOR ART

Previously disclosed floating bodies consist of a buoyant material which is bulky during storage of the floating bodies in question, or are subject to the risk of sinking if one or more of the containers capable of being filled with air, etc., are punctured. The manufacture of such floating bodies has also been complicated by the number of process stages to be performed and by the large number of components of varying complexity to be joined together. Furthermore, the handling of such previously disclosed floating bodies has been difficult and heavy.

The principal object of the present invention is thus, in the first instance, to make available an arrangement of the kind indicated in accordance with the present invention.

SUMMARY OF THE INVENTION

The aforementioned object is achieved by means of an arrangement in accordance with the present invention, which is characterized essentially in that containers communicate with one another via a duct extending outside the aforementioned containers and along the floating body, which duct is situated at a level below the surface of the water in which the floating body is adapted to float in its inflated state.

BRIEF DESCRIPTION OF THE DRAWINGS

The present invention is described below as a number of preferred illustrative embodiments with reference to the accompanying drawings, which illustrate the invention in the form of booms, where:

FIG. 1 shows a boom in its extended position viewed in the direction of one long side of the boom;

FIG. 1A shows an example of the deployment of the boom;

DETAILED DESCRIPTION OF THE PREFERRED EMBODIMENT

Figure 2:
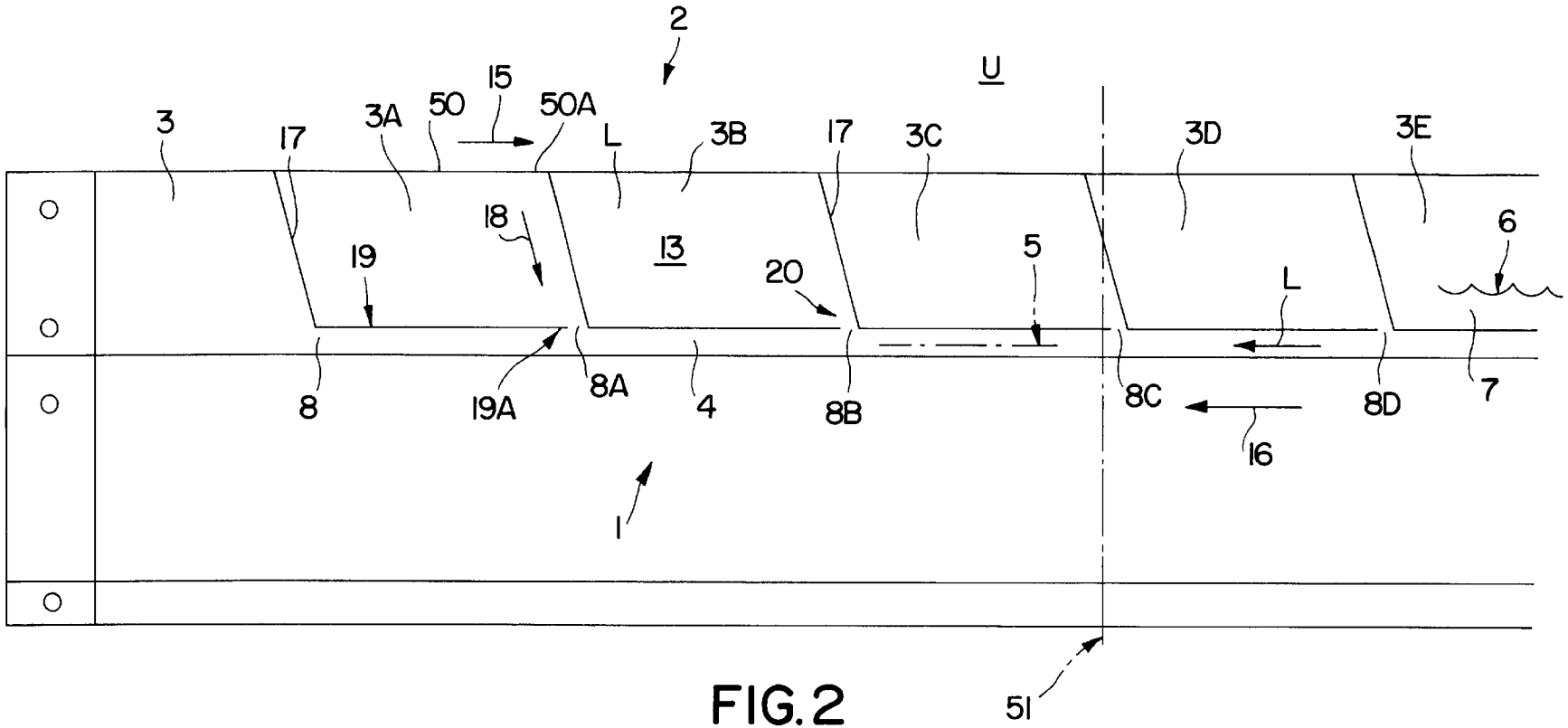
FIG. 2 shows an end section of the boom.
Figure 3:
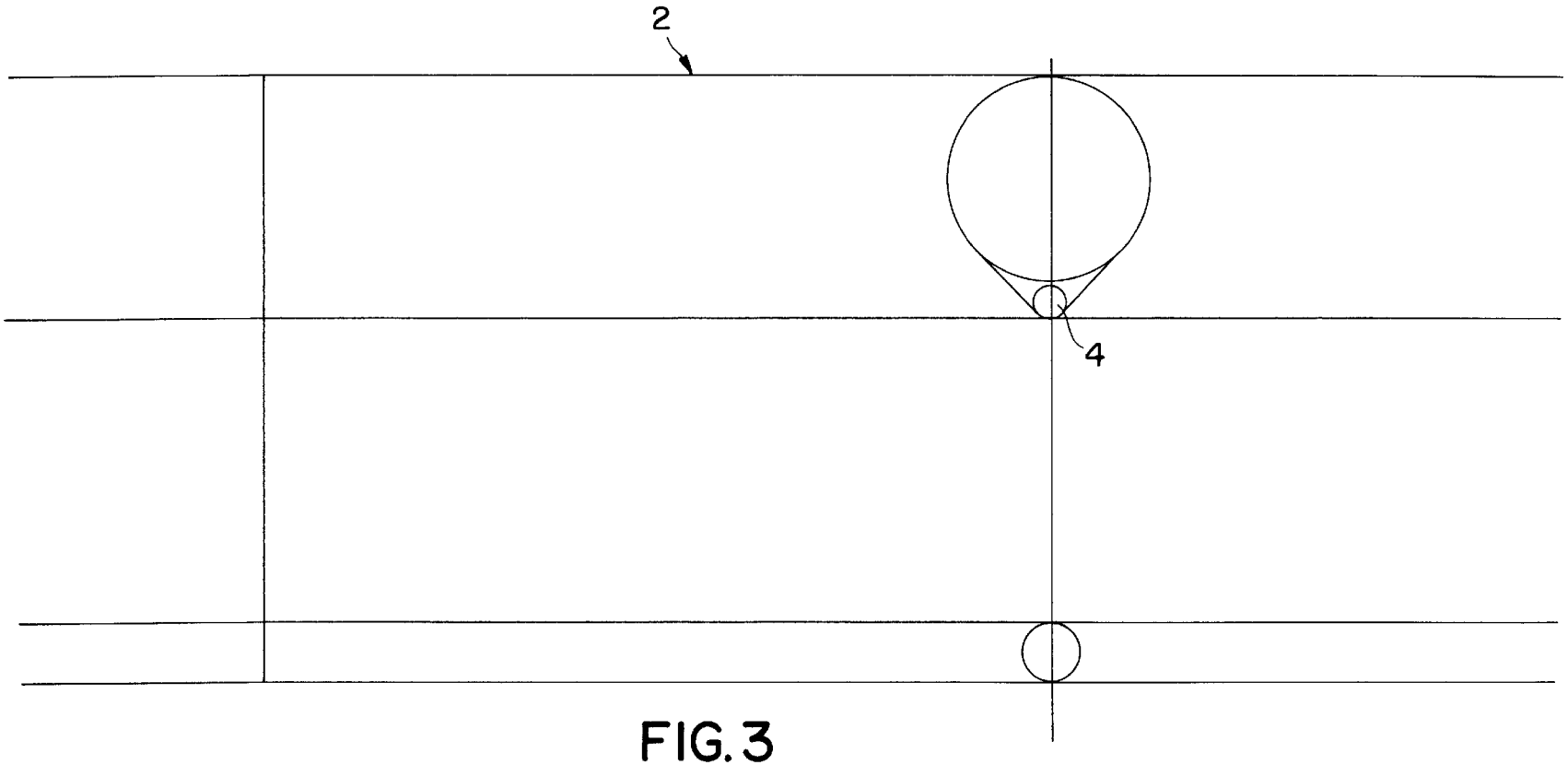
FIG. 3 shows the central section of the boom, with its cross-section marked.

For the sake of simplicity, the invention is described and illustrated below only in conjunction with a so-called boom, although the invention can naturally also be applied to other kinds of floating bodies which are subject to the risk of puncturing of containers intended to hold a gas, for example life-saving equipment and boats, etc. The invention can be applied, for example, in conjunction with ships as a buoyancy aid for the ship, for instance where there is a risk of the ship sinking.

Other areas of application are as a buoyancy jacket for people or as a means of protecting boats against ice when the boats are laid up f or the winter in water enclosed by the invention in the form of inflatable containers.

The present invention relates to an arrangement 1 for a floating body 2 comprising a desired number of containers 3, 3A, 3B, 3C, 3D, 3E . . . 3*n* made of a flexible material and capable of being filled with air L or other gas, which containers are arranged laterally offset in relation to one another and communicate with one another. More specifically, the aforementioned containers 3–3*n* communicate with one another via a duct 4 which extends outside said containers 3–3*n* and along the aforementioned floating body 2. The duct 4 is situated at a level 5 below the surface 6 of the water 7 in which the aforementioned floating body 2 is adapted to float in its inflated state U. For example when a boom 2 is laid in the water 7 around a vessel F, which has run aground and is leaking oil, in order to contain the oil and prevent it from reaching and contaminating beaches, etc., then the oil can be taken up with an oil collector. It can also be used in streams and rivers, etc., in order to form a barrier from shore to shore across the watercourse in question, or it can be towed behind a vessel.

The aforementioned containers 3–3*n* have inlets 8, 8A, 8B, 8C, 8D . . . 8*n*, which are connected to the aforementioned duct 4, in the form of flexible material.

The inlet 8–8*n* is formed preferably by a tube 9, a passage or some other suitable device, which is capable of being compressed laterally in the directions 10, 11 towards one another, across the extent of the floating body in the longitudinal sense 12, in order to close the internal cavities 13 of the containers and to prevent the air L that is already present in the other containers from escaping, and in order to prevent water 7 from entering the containers 3–3*n* of the floating body and into the air duct 4 from the surrounding water 7 in which the floating body 2 is floating at the time of puncturing.

Illustrated in FIGS. 4–8 are embodiments in which the inlet 8–8*n* discharges into an extended part 14 of the air duct 4 so as to permit the inlet tube 9 to be folded when the containers 3–3*n* are affected in such a way that they fold along the area 4A of the air duct. The tube 9 is thus caused by waves to fold in front of the closure.

A number of containers 3–3*n*, 3'–3*n*', 3"–3*n*" can be arranged so that they extend along the floating body 2 at different levels I, II, III, and so that the aforeinentioned vertically distributed containers exhibit groups of tubes 9 leading to the aforementioned duct 4

Figure 7A:
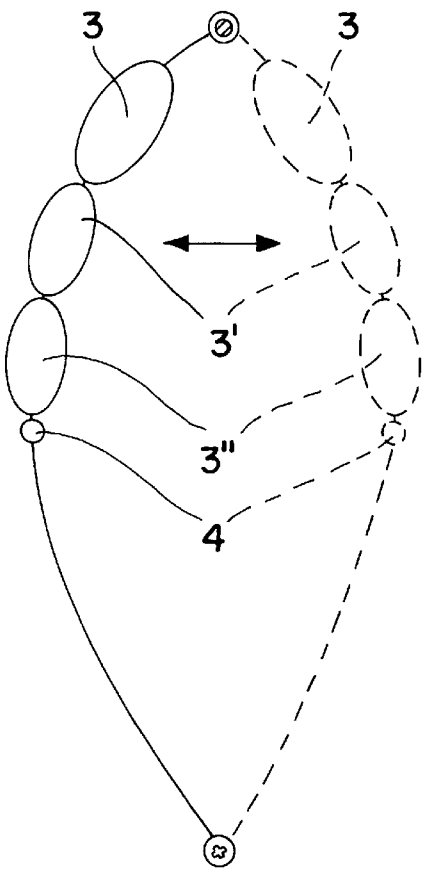
FIG. 7A shows an edge view of this boom in two different marked positions.
Figure 7:
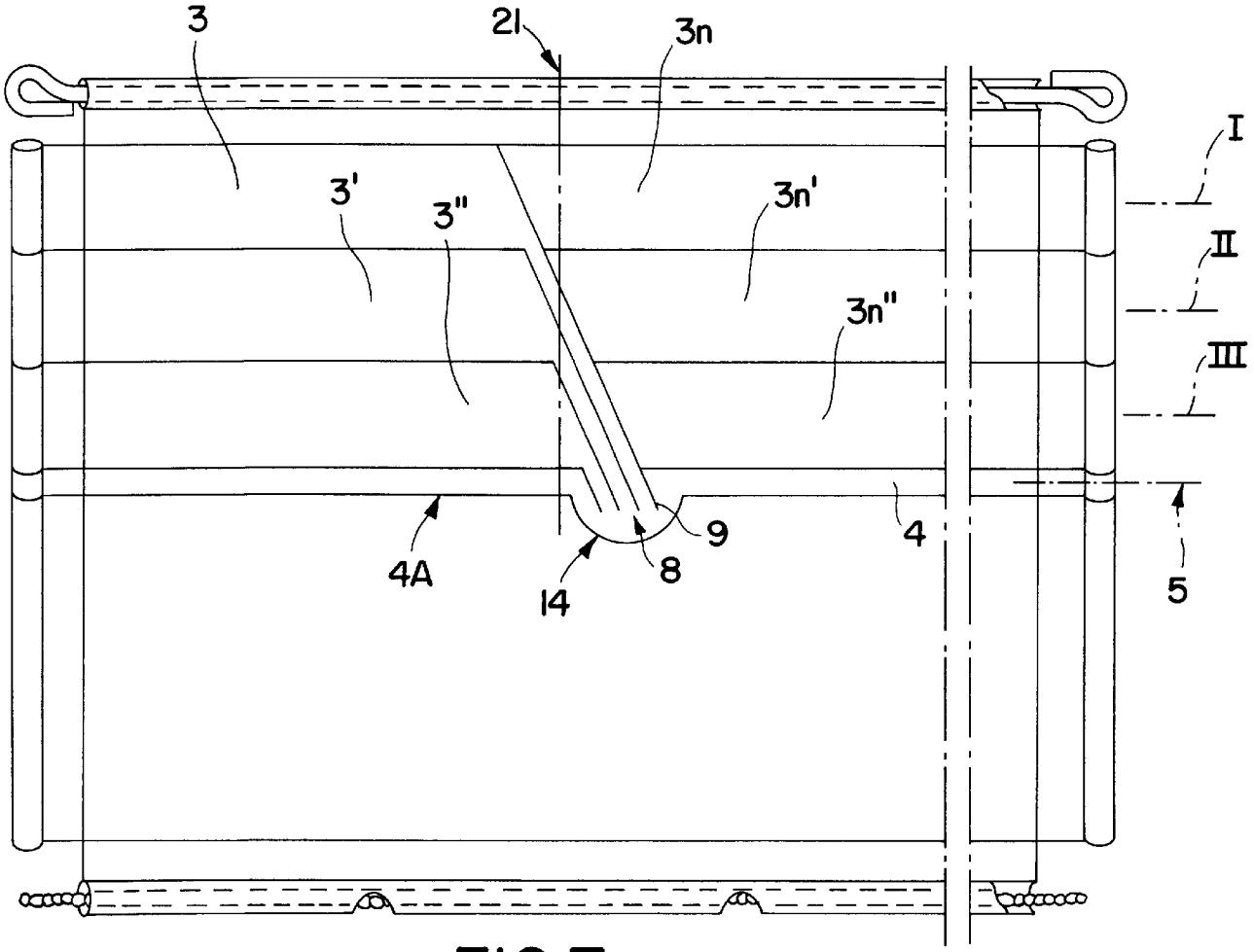
FIG. 7 shows a further example of a boom viewed from the side.

FIG. 7 uses solid and dashed lines to illustrate two positions for a boom affected laterally to the left and to the right, for example by waves, the watercourse or currents of water (ebb and flow), etc.

The containers preferably converge towards 15 the air supply direction 16, and the containers exhibit an inclined end closure 17 inclined in a direction 18 towards the bottom 19 of the containers so as to form a folding notch, at the same time as the folding closes the tubes 9 and causes the floating body 2 to float better over the waves in the water 7.

The fact that the inlet 8–8*n*, which thus also forus an outlet for the air L when emptying the boom 2, in the respective containers 3–3*n* is situated in the area of its rear end 20, viewed along the air supply direction 16 of the air duct, enables the air L to be emptied completely from the respective container 3–3*n* by folding it together along the rear end closure 17 of the respective container, which in this way forms a folding notch or is situated in close association with such a folding notch 21.

The rear end 19A of the respective container bottom 19 is situated laterally offset rearwards beyond the rear end 50A of the respective upper part 50 of the container, that is to say laterally displaced beyond a vertical line 51 which runs from the rear end 50A.of the upper part of the container.

The floating body 2 can thus be formed from the upper part of a boom. A skirt 22 of preferably flexible cloth material suspended beneath this floating body 2 can be attached so as to extend downwards to the intended level to form a barrier for the purpose of confining or collecting substances 23, such as oil, which find their way unintentionally into the water 7.

Figure 4:
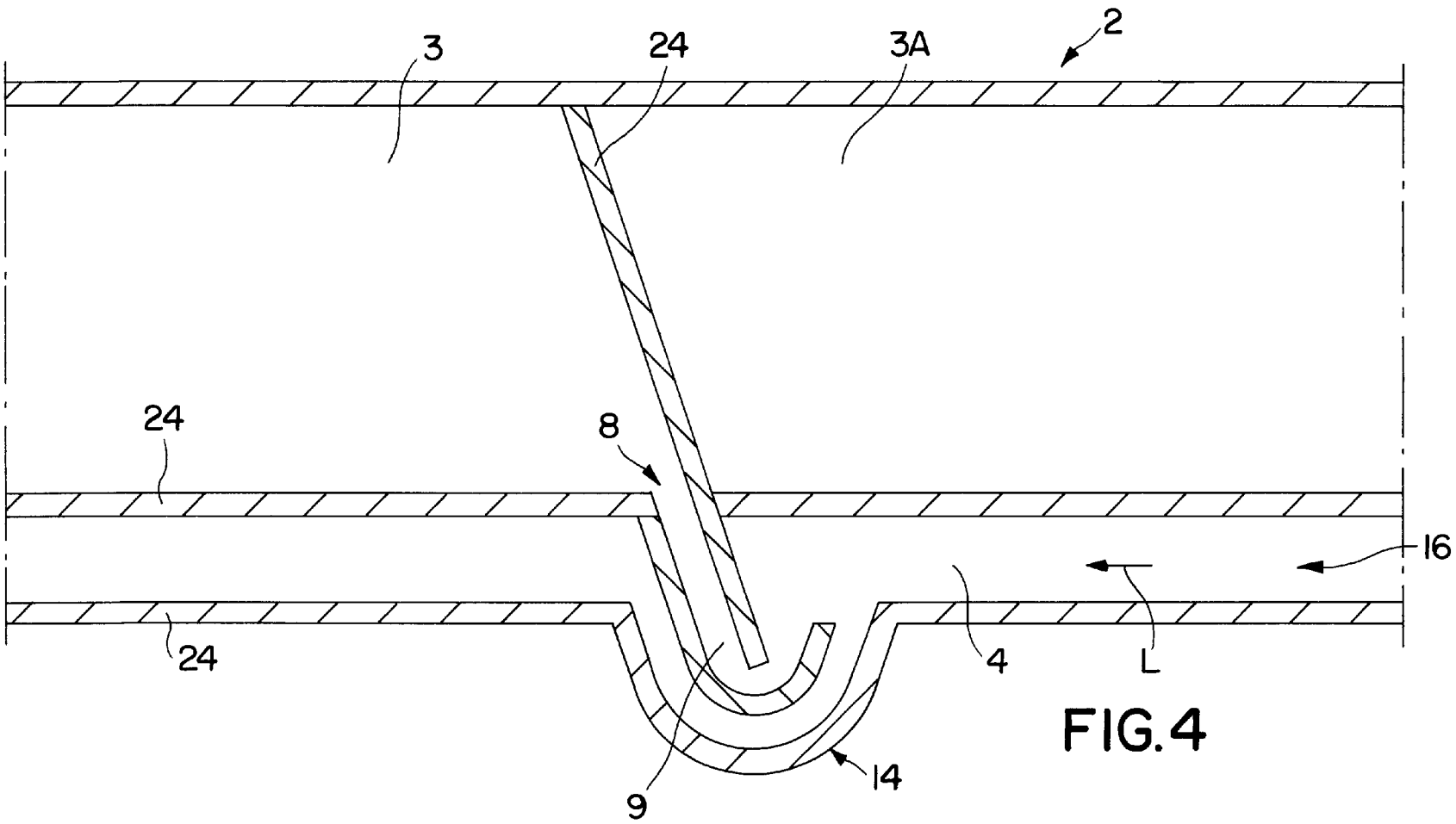
FIG. 4 shows a cross-section of a part of the boom which exhibits an air valve.
Figure 5:
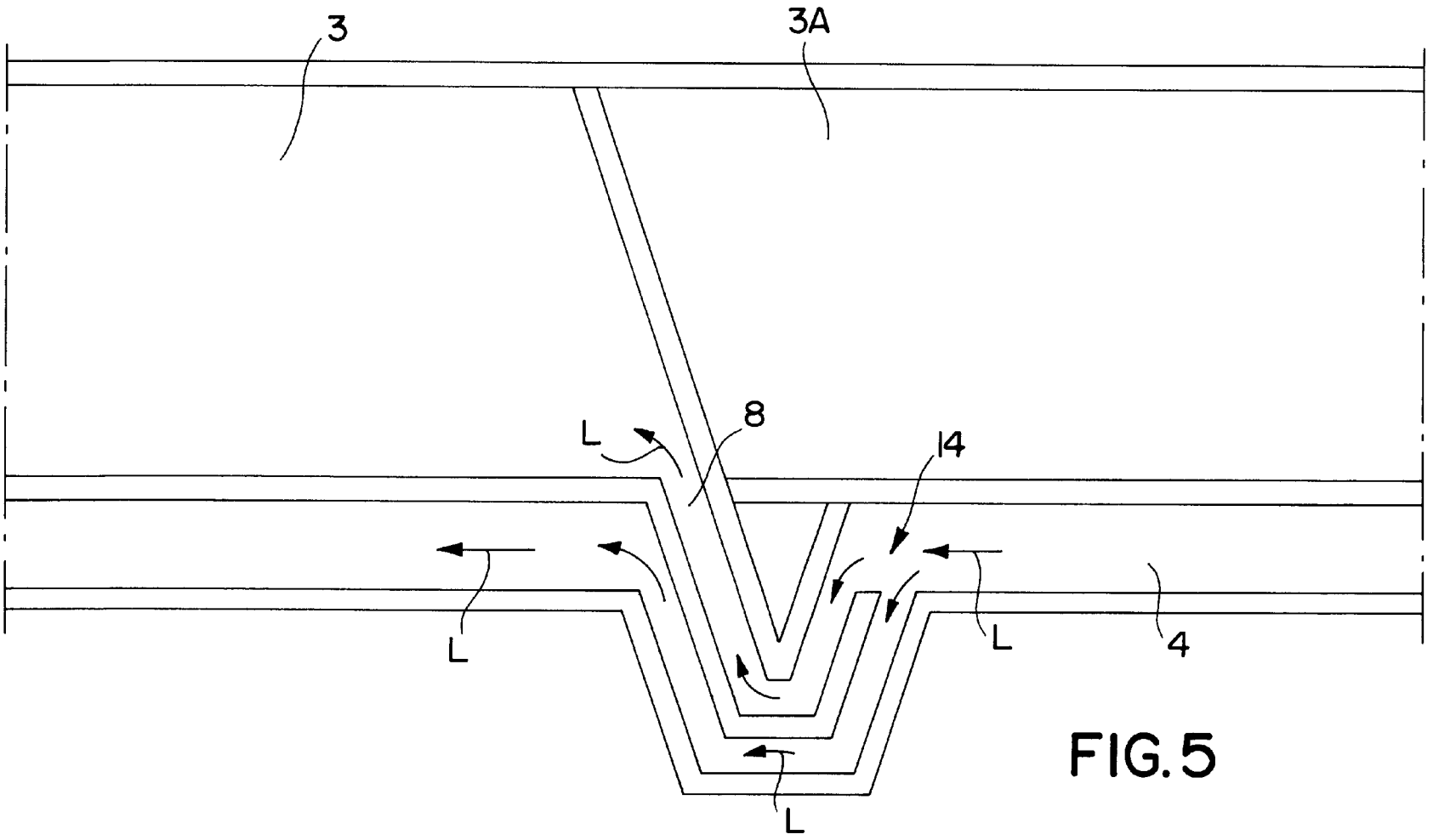
FIG. 5 shows a further example of an air valve.
Figure 6:
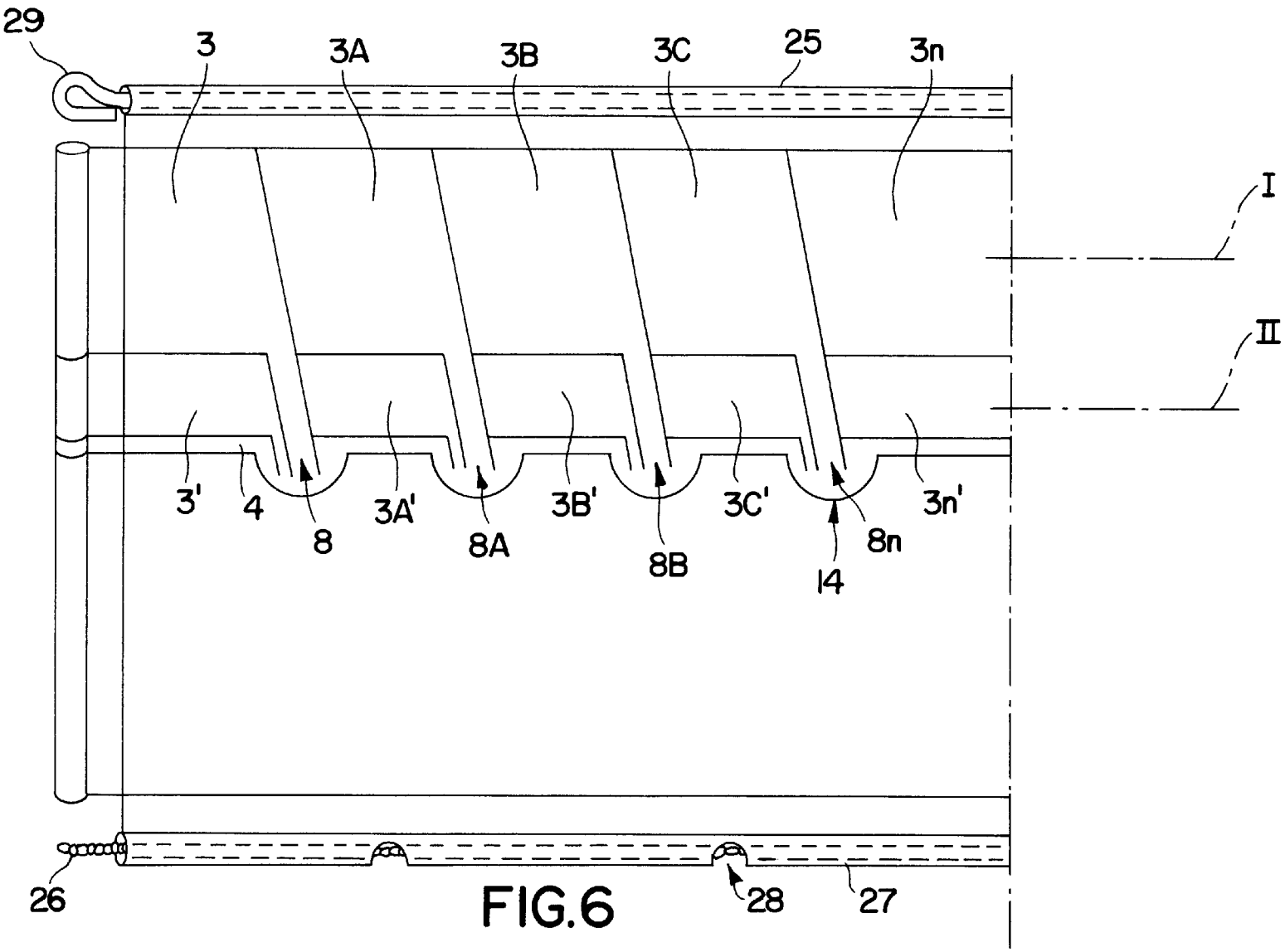
FIG. 6 shows an example of a boom illustrating its constituent component parts.

The boom can thus be produced using a common cloth material, in which case the cloth material is double at least in the area of the container and the air duct, and the cloth materials are joined together, for example by welding or gluing, etc., at joints 24 arranged for that purposes along the container, tube and ducts, etc., as shown for example in FIG. 4.

Filling of a boom, etc., 2 fed out from a reel or a box takes place by feeding air L, etc., in a common direction 16 from, for example, a pump on board a vessel F, in conjunction with which the containers 3–3*n* in the floating body 2 are filled successively with air in a direction 16 from the rear 2B towards its front part 2A, that is to say when a container 3*n* situated at the rear is filled so that no more air can be contained in it, the air L flows onwards into the duct 4 and fills the next container in line, and so on until all the containers 3–3*n*, connected in a line one after the other in series,in the chain are full, and filling of the boom is complete.

In the event of a puncture occurring in one or more of the aforementioned containers 3–3*n*, the surrounding water 7, in which the floating body 2 is contained, will force together the inlet 8–8*n* of the punctured container in question, thereby preventing any water which entered the internal cavity 13 of the punctured container at the time of puncturing from entering the rest of the air-filled system of duct 4 and containers 3–3*n* and/or the air leaking out from that point via the puncture hole and destroying the ability of the entire floating body to float. The floating body 2 is thus able to float, even if it exhibits puncturing of one or more of its constituent containers 3–3*n*, without the use of other buoyancy material.

Figure 10:
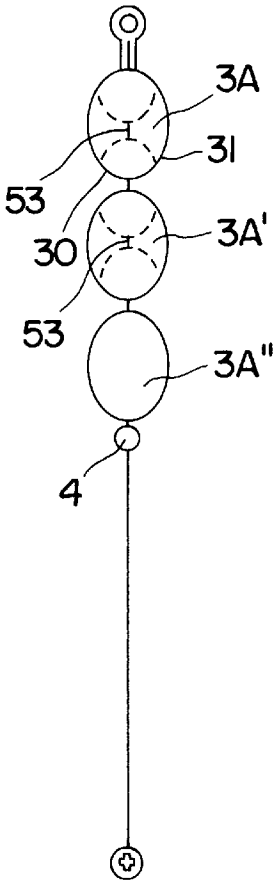
FIG. 10 is a sectional view along the line X—X marked in FIG. 8.
Figure 9:
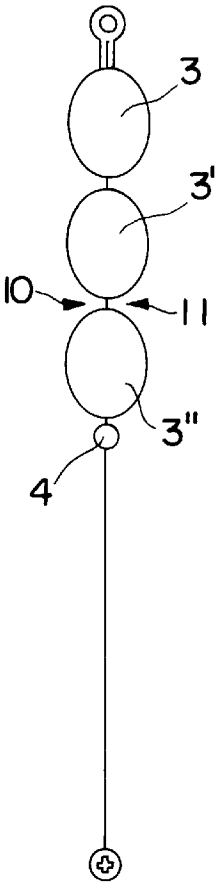
FIG. 9 shows a sectional view along the line IX—IX marked in FIG. 8.
Figure 8:
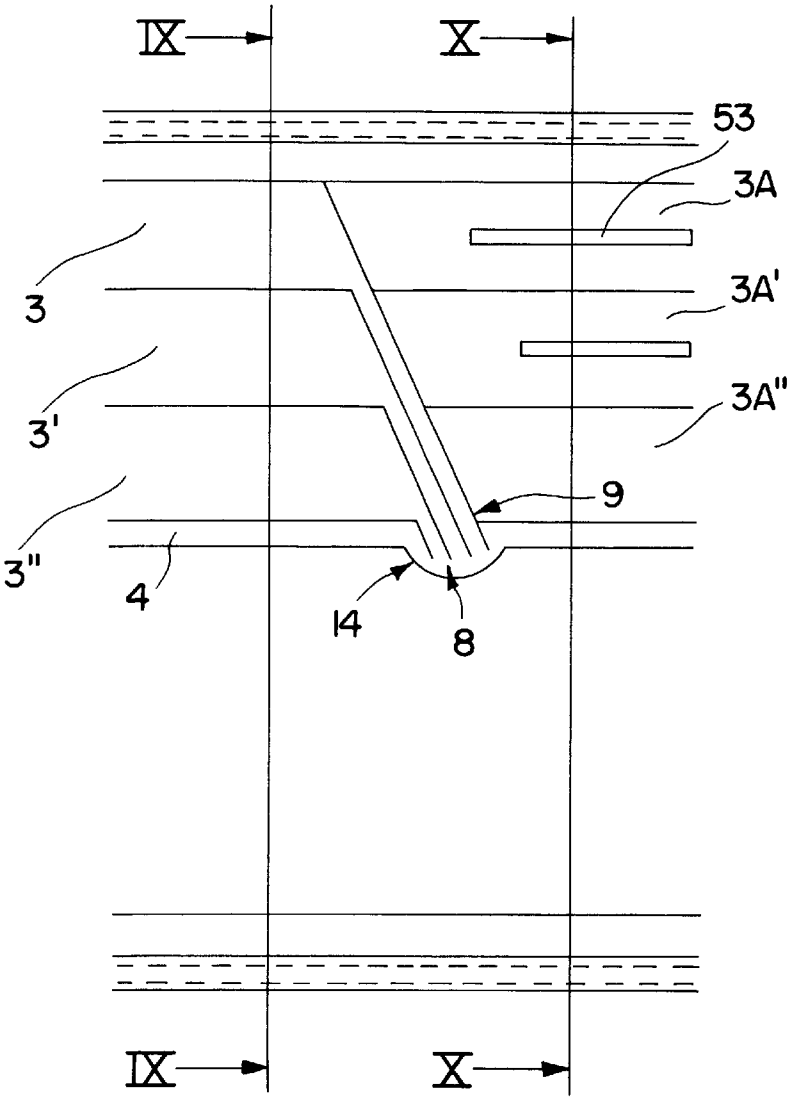
FIG. 8 shows a further illustrative embodiment of a boom.

FIGS. 8 and 10 illustrate how welds 53 can extend along the container 3A, 3A' and connect the side walls 30, 31 of the container together so that the containers have a compact form.

Figure 12:
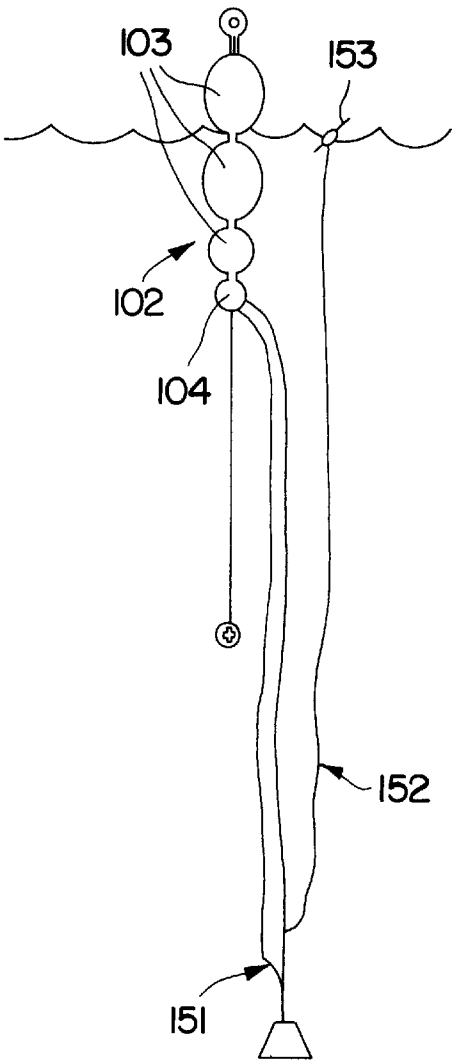
FIG. 12 is an end view of the boom with a valve tube attached.
Figure 11:
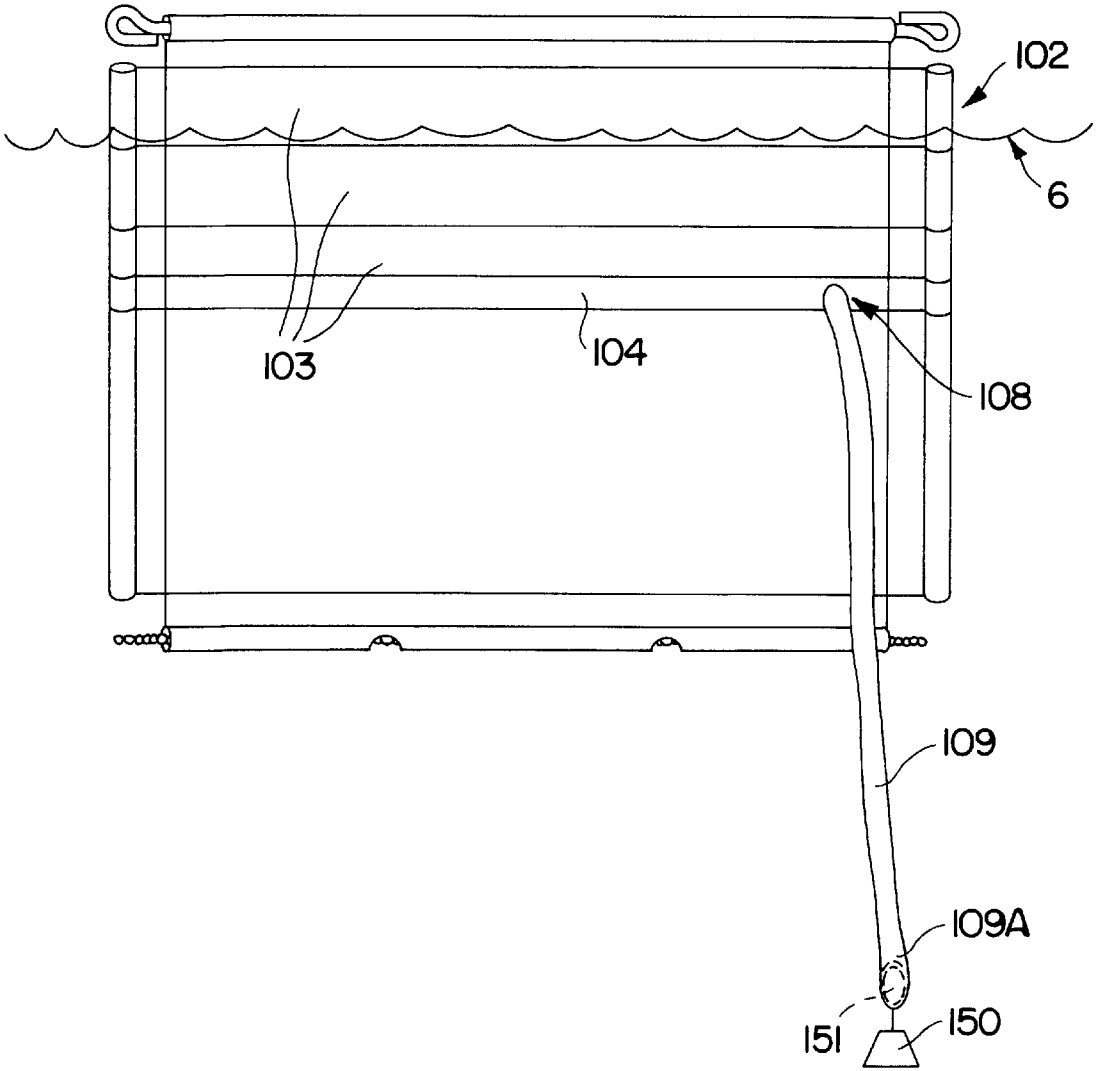
FIG. 11 is a side view of a variant of a boom with a valve tube attached.

FIGS. 11–12 illustrate examples of inlets 108 in a floating body 102, which can comprise an elongated tube 109 with weights 150 in its free end 109A, where an opening 151 is located for the introduction of air into containers 103 situated for that purpose in the inside of the floating body. When it is proposed to introduce air via the duct 104 into the containers 103, the tube 109 can be raised via the float 153 of the hauling line 152 floating on the surface 6 of the water. The opening 151 in the tube thus need not be closed by means of a special closure, but the tube is kept closed with the help of the surrounding pressure of the water against its sides, which are made of a flexible and easily compressible material, for example plastic or rubber, in order to inte handling of the floating body 102 simple and reliable and rapid, without the need for complicated closures which are easily contaminated and rendered unusable.

The boom shown in the drawings can be arranged in other respects in a previously disclosed fashion, that is to say provided with an upper hauling line 29 enclosed inside a tunnel 25. At the bottom the boom exhibits a weight, for example a chain 26, which extends along the lower part of the boom in a channel 27. Openings 28 in the channel 27 permit access to the chain 26 for the purpose of attaching anchor weights to the chain 26.

The invention is not restricted to the illustrative examples described above and illustrated in the drawings, but may be varied within the context of the patent claims without departing from the idea of invention. The principle of the invention is thus, by utilizing the pressure of the surrounding water and folds in the boom, etc., to close inlets for the respective containers without the need for complex arrangements for this purpose to be present.

I claim:

1. An arrangement for a floating body comprising:

a plurality of containers made from a flexible material, each positioned laterally in relation to one another and inflatable with air or other gas;

a duct communicating with the containers and extending outside the containers and along the floating body, said duct situated at a level below the surface of the water in which the floating body is adapted to float in an inflated state; and a plurality of inlets, each formed by a tube of flexible material having an internal cavity; the tube adapted to be compressed in order to close the internal cavity, a respective inlet connected between a respective container and said duct.

2. The arrangement as claimed in Patent claim 1, wherein each of said inlets discharges into an extended part of the duct.

3. The arrangement as claimed in claim 2, wherein a number of the containers extend alone the floating body at different levels, and wherein the duct is situated at a level below the containers.

4. The arrangement as claimed in claim 2, wherein the containers converge towards an air supply direction.

5. The arrangement as claimed in claim 1, wherein a number of the containers extend along the floating body at different levels, and wherein the duct is situated at a level below the containers.

6. The arrangement as claimed in Patent claim 5, wherein the containers are vertically distributed and exhibit groups of tubes leading to the duct.

7. The arrangement as claimed in claim 6, wherein the containers converge towards an air supply direction.

8. The arrangement as claimed in claim 5, wherein the containers converge towards an air supply direction.

9. The arrangement as claimed in claim 1, wherein the containers converge towards an air supply direction.

10. The arrangement as claimed in Patent claim 9, wherein the containers exhibit an inclined end closure inclined in a direction towards their bottom and the duct, so as to form a folding notch which, at the same time, seals against the escape of air and the ingress of water, whereby the containers remain sealed for as long as folding continues to take place.

11. The arrangement as claimed in claim 1, wherein the floating body is formed from the upper part of a boom, and wherein a skirt of preferably flexible cloth material attached beneath it extends downwards to insert intended level to form a barrier for the purpose of confining or collecting substances.

12. The arrangement as claimed in claim 1, wherein the containers have a rear end, viewed along an air supply direction of the duct, in the area of which the inlets are situated.

* * * * *